US006541946B1

(12) United States Patent
Chen et al.

(10) Patent No.: US 6,541,946 B1
(45) Date of Patent: Apr. 1, 2003

(54) LOW DROPOUT VOLTAGE REGULATOR WITH IMPROVED POWER SUPPLY REJECTION RATIO

(75) Inventors: Jun Chen, Allen, TX (US); Xiaoyu Xi, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/102,501

(22) Filed: Mar. 19, 2002

(51) Int. Cl.[7] ..... G05F 1/40
(52) U.S. Cl. ..... 323/280; 323/281; 323/274
(58) Field of Search ..... 323/273, 276, 323/280, 281, 274

(56) References Cited

U.S. PATENT DOCUMENTS 6,300,749 B1 * 10/2001 Castelli et al. ..... 323/273
6,465,994 B1 * 10/2002 Xi ..... 323/274

* cited by examiner

*Primary Examiner*—Shawn Riley
(74) *Attorney, Agent, or Firm*—Alan K. Stewart; W. James Brady, III; Frederick J. Telecky, Jr.

(57) ABSTRACT

The low dropout voltage regulator (LDO) circuit with improved power supply rejection ratio includes: a first amplifier 20 having a first input coupled to a reference voltage node $V_{ref}$; a second amplifier 22 having an input coupled to an output of the first amplifier 20; a pass transistor 24 having a control node coupled to an output of the second amplifier 22; a feedback circuit 26 and 28 having an input coupled to the pass transistor 24 and an output coupled to a second input of the first amplifier 20; an inverting gain stage 36 coupled to the input of the second amplifier 22; and a high pass filter 42, 44, and 38 coupled between a power supply node and a control node of the inverting gain stage 36. The circuit uses the high pass filter 42, 44, and 38 and inverting gain stage 36 to feedforward the power supply ripple into the LDO's control loop which counter-acts the impact of the supply ripple on the output node $V_o$.

20 Claims, 1 Drawing Sheet

LOW DROPOUT VOLTAGE REGULATOR WITH IMPROVED POWER SUPPLY REJECTION RATIO

FIELD OF THE INVENTION

This invention generally relates to electronic systems and in particular it relates to low dropout voltage regulators with improved power supply rejection ratios.

BACKGROUND OF THE INVENTION

Low dropout voltage regulators (LDO) are widely used to step down battery voltage and suppress voltage disturbances from batteries or switching regulators in portable electronics equipment, such as cellular phones, MP3, and digital cameras. Power supply rejection ratio (PSRR) of the LDO, defined as the capability of rejecting input supply voltage ripple at the output of the LDO, is a very important requirement in LDO design.

A conventional prior art LDO is shown in FIG. 1. The prior art circuit includes error amplifier 20; amplifier 22; PMOS pass transistor 24; feedback resistors 26 and 28; load resistance 30; load capacitance 32; supply voltage $V_{in}$; reference voltage $V_{ref}$; and output voltage $V_o$. In many conventional LDO designs, such as the prior art LDO shown in FIG. 1, power supply disturbance is suppressed by a negative feedback circuit consisting of an error amplifier 20, amplifier 22, and pass transistor 24. The PSRR is mainly determined by the open-loop gain of amplifier 20, amplifier 22, and pass transistor 24, and position of internal poles. The conventional prior art LDO suffers from an inherent PSRR performance limitation due to the continuous roll-off of open-loop gain with increasing frequency and limited bandwidth of the error amplifier 20. Therefore, to design a high-PSRR LDO, a control loop with high gain and high bandwidth is needed, which, however, sometimes conflicts with other requirements such as stability and current consumption.

SUMMARY OF THE INVENTION

A low dropout voltage regulator (LDO) circuit with improved power supply rejection ratio includes: a first amplifier having a first input coupled to a reference voltage node; a second amplifier having an input coupled to an output of the first amplifier; a pass transistor having a control node coupled to an output of the second amplifier; a feedback circuit having an input coupled to the pass transistor and an output coupled to a second input of the first amplifier; an inverting gain stage coupled to the input of the second amplifier; and a high pass filter coupled between a power supply node and a control node of the inverting gain stage. The circuit uses the high pass filter and inverting gain stage to feedforward the power supply ripple into the LDO's control loop which counter-acts the impact of the supply ripple on the output node.

DESCRIPTION OF PREFERRED EMBODIMENTS

Figure 1:
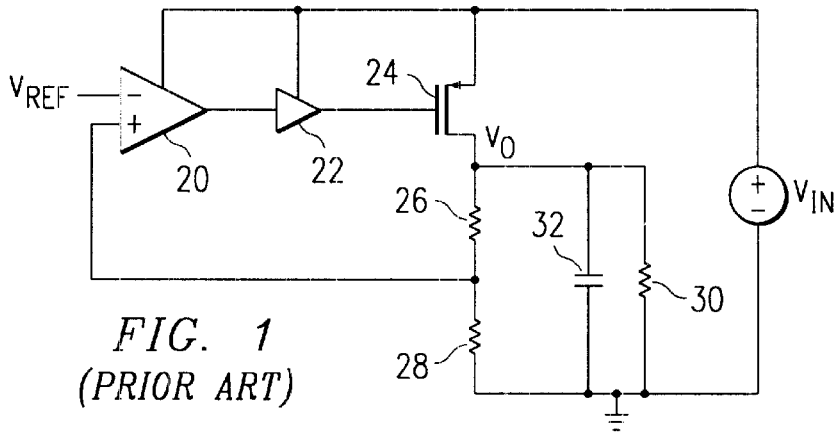
FIG. 1 (PRIOR ART)
FIG. 1 is a schematic circuit diagram of a prior art low dropout voltage regulator.
Figure 2:
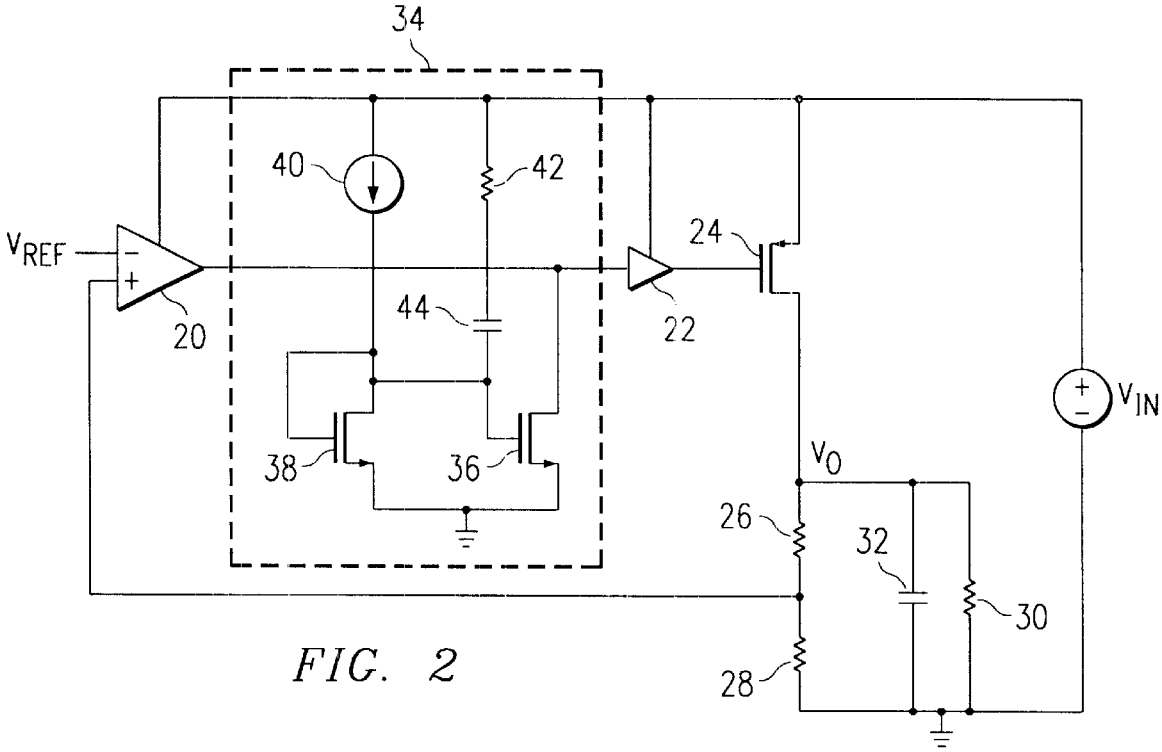
FIG. 2 is a schematic circuit diagram of a preferred embodiment low dropout voltage regulator with improved power supply rejection ratio.

A preferred embodiment low dropout voltage regulator (LDO) circuit with improved power supply rejection ratio (PSRR) performance is shown in FIG. 2. This circuit significantly improves the PSRR performance by feeding the supply ripple into the control loop to counteract the supply change. Thus, the gain and bandwidth of the LDO and its architecture can remain unchanged. The PSRR help circuit is simple, easy to use, and requires very small quiescent current.

The preferred embodiment circuit of FIG. 2 includes error amplifier 20; amplifier 22; PMOS pass transistor 24; feedback resistors 26 and 28 (voltage divider); load resistance 30; load capacitance 32; source voltage $V_{in}$; reference voltage $V_{ref}$; output voltage $V_o$; and PSSR help circuit 34. The PSSR help circuit 34 includes: two transistors 36 and 38, current source 40, resistor 42, and capacitor 44. Transistor 36 serves as an inverting gain stage. Transistor 38 provides DC bias for transistor 36. Resistor 42, capacitor 44, and transistor 38 form a high-pass filter that also attenuates the supply ripple at the input of transistor 36. This attenuation factor should be chosen based on the gain of transistor 36 and amplifier 22. The pass band of the high-pass filter is at the frequency range of interest for the PSRR.

Transistor 36 and amplifier 22 consist of a non-inverting gain stage, which feeds the supply ripple to the gate of PMOS transistor 24. During a power supply ripple, when the power supply voltage goes high, the gate voltage of transistor 36 also goes high because the voltage ripple is coupled through the high-pass filter formed by resistor 42, capacitor 44, and transistor 38. This sampled supply ripple is then amplified by transistor 36 and amplifier 22. This drives the gate of power PMOS transistor 24 high, and reduces the current change in PMOS transistor 24 due to the supply change. As a result, the disturbance of power supply voltage $V_{in}$ is counteracted at the output $V_o$, and a better power supply rejection is achieved.

The preferred embodiment circuit shown in FIG. 2 significantly improves the low dropout voltage regulator's (LDO) PSRR (power supply rejection ratio). Using this circuit to improve the LDO's PSRR does not change the LDO's architecture and control loop. The PSRR help circuit 34 is simple, and requires negligible quiescent current.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A circuit comprising:

a first amplifier having a first input coupled to a reference voltage node;

a second amplifier having an input coupled to an output of the first amplifier;

a pass transistor having a control node coupled to an output of the second amplifier;

a feedback circuit having an input coupled to the pass transistor and an output coupled to a second input of the first amplifier;

an inverting gain stage coupled to the input of the second amplifier; and a high pass filter coupled between a power supply node and a control node of the inverting gain stage.

2. The circuit of claim 1 wherein the pass transistor is a PMOS transistor.

3. The circuit of claim 1 wherein the inverting gain stage is a transistor.

4. The circuit of claim 1 wherein the inverting gain stage is an NMOS transistor.

5. The circuit of claim 1 wherein the high pass filter comprises:

a resistor having a first end coupled to the power supply node;

a capacitor coupled between the control node of the inverting gain stage and a second end of the resistor; and a transistor coupled between the control node of the inverting gain stage and a common node.

6. The circuit of claim 5 further comprising a current source coupled between the power supply node and the transistor.

7. The circuit of claim 5 wherein a control node of the transistor is coupled to the control node of the inverting gain stage.

8. The circuit of claim 1 wherein the feedback circuit is a voltage divider circuit.

9. The circuit of claim 8 wherein the voltage divider circuit comprises two resistors coupled in series.

10. The circuit of claim 1 wherein the feedback circuit comprises:

a first resistor coupled between the input of the feedback circuit and the output of the feedback circuit; and a second resistor coupled between the output of the feedback circuit and a common node.

11. A low dropout voltage regulator comprising:

a first amplifier having a first input coupled to a reference voltage node;

a second amplifier having an input coupled to an output of the first amplifier;

a pass device having a first end coupled to a power supply node and having a control node coupled to an output of the second amplifier;

a feedback circuit having an input coupled to a second end of the pass device and an output coupled to a second input of the first amplifier;

an inverting gain stage coupled to the input of the second amplifier; and a high pass filter coupled between a power supply node and a control node of the inverting gain stage.

12. The circuit of claim 11 wherein the pass device is a transistor.

13. The circuit of claim 11 wherein the pass device is a PMOS transistor.

14. The circuit of claim 11 wherein the inverting gain stage is a transistor.

15. The circuit of claim 11 wherein the inverting gain stage is an NMOS transistor.

16. The circuit of claim 11 wherein the high pass filter comprises:

a resistor;

a capacitor coupled in series with the resistor wherein the capacitor and the resistor are coupled between the power supply node and the control node of the inverting gain stage; and a transistor coupled between the control node of the inverting gain stage and a common node.

17. The circuit of claim 16 further comprising a current source coupled between the power supply node and the transistor.

18. The circuit of claim 17 wherein a control node of the transistor is coupled to the control node of the inverting gain stage.

19. The circuit of claim 11 wherein the feedback circuit is a voltage divider circuit.

20. The circuit of claim 11 wherein the feedback circuit comprises:

a first resistor coupled between the input of the feedback circuit and the output of the feedback circuit; and a second resistor coupled between the output of the feedback circuit and a common node.

* * * * *